United States Patent [19]

Sovari et al.

[11] 4,125,203

[45] Nov. 14, 1978

[54] TWIST CAN TOP

[76] Inventors: Janos Sovari; Geza J. Budai, both of P.O. Box 385, Tahoe City, Calif. 95730

[21] Appl. No.: 799,870

[22] Filed: May 23, 1977

[51] Int. Cl.[2] ..... B65D 51/22

[52] U.S. Cl. ..... 220/258; 220/272

[58] Field of Search ..... 222/541, 80, 83, 85; 220/268, 269, 258, 253, 255, 256, 272

[56] References Cited

U.S. PATENT DOCUMENTS

| | | | |
|---|---|---|---|
| 2,439,978 | 4/1948 | Konchan | 220/253 |
| 3,386,613 | 6/1968 | Traynor | 220/269 |
| 3,726,432 | 4/1973 | Gentile | 220/258 |
| 3,845,880 | 11/1974 | Cole, Jr. | 220/258 |
| 3,860,111 | 1/1975 | Thompson | 220/253 |
| 3,908,856 | 9/1975 | Perry | 220/269 |
| 4,039,101 | 8/1977 | Wells | 220/258 |

FOREIGN PATENT DOCUMENTS

| | | | |
|---|---|---|---|
| 248,645 | 12/1963 | Australia | 220/253 |

*Primary Examiner*—William Price
*Assistant Examiner*—Joseph Man-Fu Moy
*Attorney, Agent, or Firm*—Townsend and Townsend

[57] ABSTRACT

A cylindrical container having a circular top with a pull tab formed therein which is connected to an auxiliary rotatable lid fitted over the circular top so that upon rotation of the rotatable lid, the pull tab is torn back to create a dispensing opening in the circular top. The rotatable lid is provided with an opening which, when registered with the dispensing opening in the circular top, provides an opening through which the contents of the container may be poured.

14 Claims, 18 Drawing Figures

TWIST CAN TOP

BACKGROUND OF THE INVENTION

1. Field of the Invention

This invention relates to an easy opening container, and more particularly to a cylindrical container having an auxiliary rotatable lid connected to a pull tab which, when the rotatable lid is manually twisted in rotation, severs and pulls back the pull tab to provide an opening for dispensing the contents of the container.

2. Description of the Prior Art

Easy opening containers with self-opening tops have been used extensively in the marketing of carbonated liquids, particularly beer and soft drinks. The advantage of these containers is that no additional can opener is necessary.

Conventional easy opening containers with self-opening tops include containers having detachable tabs with pull rings which are adapted to be manually severed from the top of the can. Removed ring tabs are often thrown on the ground causing litter and potential injury due to the sharpness of the metal edges. Where, as occasionally occurs, the user disposes of the tab by dropping it into the container before drinking its contents, the ring tabs have been swallowed resulting in injury.

SUMMARY OF THE INVENTION

This invention provides a cylindrical container having a circular metal top with a scribed, scored or otherwise severable pull tab formed therein. An auxiliary rotatable lid is mounted on the top of the container and connected to the severable tab. When the rotatable lid is rotated, it tears back the tab to form an opening in the circular top. An opening is provided in the rotatable lid which, when the lid has been rotated to fully retract the tab, registers with the opening formed in the circular top to provide an opening for dispensing the contents of the can.

The can top is of thin, easily torn metal such as aluminum. The interior of the can top may be covered with a thin film of non-toxic, non-degradable plastic which prevents the metal from leaching into the liquid contents of the can.

In one embodiment, the pull tab is connected to the rotatable lid by a short, connector member. In another embodiment, the lid is riveted or otherwise adhered directly to the tab.

When the tab is torn back, it remains connected to the rotatable lid which eliminates any disposal problem. The torn back tab is also concealed between the lid and circular top so that the user is not exposed to its sharp metal edges.

The aperture in the rotatable lid may be approximately the same shape and size as the opening in the circular top; and the edges of the lid aperture are preferably tapered downwardly, as a flange, so that they engage the edges of the dispensing opening formed in the top to provide a neat appearance, to eliminate sharp edges, and to mitigate against liquid intruding into the space between the circular top and rotatable lid. Preferably, when the container is opened, the aperture defining flange seats in the dispensing opening of the top, thereby assisting accurate alignment of the openings.

Further, the rotatable lid and circular top are provided with surface features, such as radial ribs formed by indentations and/or protuberances in the top and lid, which interlock when the can has been opened and these further assist in accurate alignment of the openings.

Figure 6:
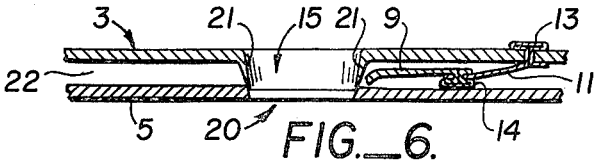
FIG. 6 is a sectional view of the container opening of the open container of FIG. 4, taken along lines 6—6 thereof.
Figure 6A:
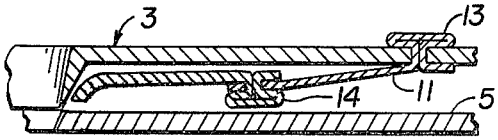

FIG. 6A is a detail view of the connection of tab 11 to the top 5 and lid 3 of FIG. 6.

Figure 7:
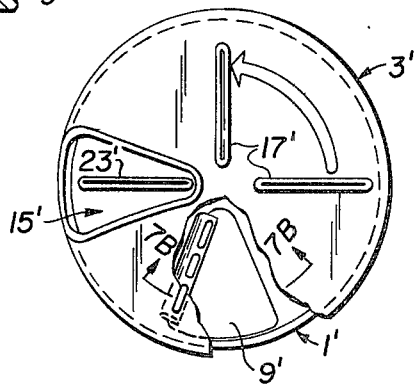

FIG. 7 is a plan view, with parts broken away, of an alternate embodiment of the present invention having an elongate pull tab.

Figure 7A:
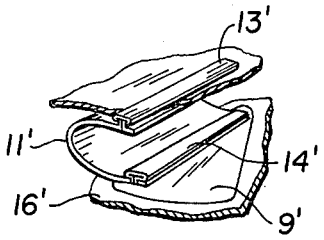

FIG. 7A is a detail perspective view of the tab 9' and 11' of FIG. 7.

Figure 7B:
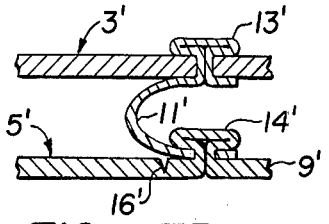

FIG. 7B is a sectional view of the tab and connection of FIG. 7A, taken along lines 7B—7B thereof.

Figure 8:
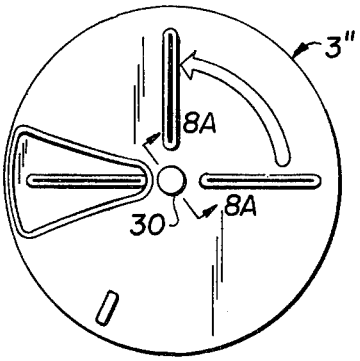

FIG. 8 is a plan view, with parts broken away, of an alternate embodiment of the present invention having a center pivot anchoring the rotatable lid to the can top.

Figure 8A:
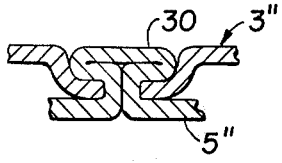

FIG. 8A is a sectional view of the center anchor of FIG. 8 taken along the lines 8A—8A thereof.

Figure 9A:
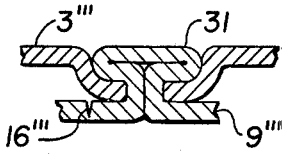
Figure 9:
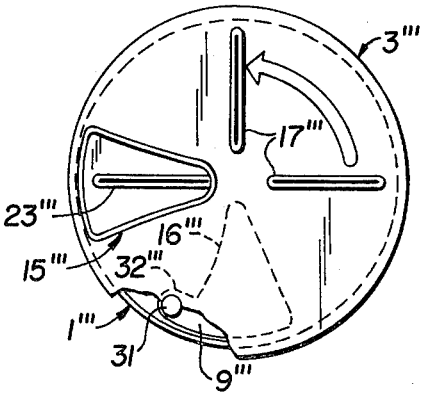

FIG. 9 is a plan view, with parts broken away, of an alternate embodiment of the present invention wherein the pull tab is riveted directly to the rotatable lid obviating the need for a connector 11.

FIG. 9A is a sectional view of the tab-lid connection of FIG. 9, taken along lines 9A—9A thereof.

Figure 10:
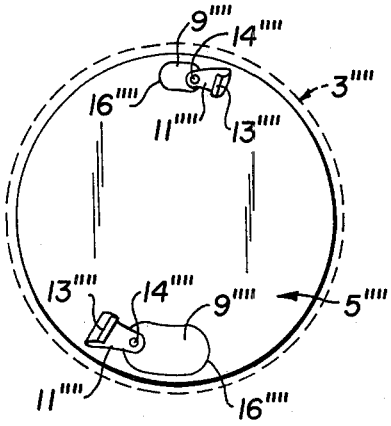

FIG. 10 is a plan view of an alternate embodiment of can top according to the present invention wherein two pull tabs are employed, a small one for air and a larger one for dispensing.

Figure 11:
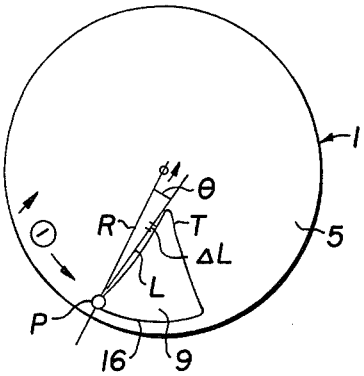

FIG. 11 is a diagram illustrating the preferred arrangement of the tab's radial tear edge relative to the radius of the rotatable lid.

DETAILED DESCRIPTION OF PREFERRED EMBODIMENTS

Referring generally to FIGS. 1–6 of the drawings, the container of the present invention consists of a hermetically sealed cylindrical metal can 1 having an auxiliary rotatable lid 3. The container 1 is adapted to hold liquids 2 such as beer or carbonated beverages and is preferrably constructed of aluminum. The container 1 has a cylindrical body portion 4, and a circular top portion 5. The bottom portion of the can (not shown) is constructed in any suitable conventional manner. The circular top 5 is joined to the cylindrical side walls 4 at a laterally projecting peripheral rim 6 crimping the top 5 over the walls 2. A tab portion 9 is formed in the circular metal top 5 by scribing. The rotatable lid 3 is mounted on the rim 6 and has a generally flat central disc portion 7 with a downwardly projecting peripheral skirt or flange 8 which encircles the container top. The lower edge of the flange 8 is crimped inwardly beneath the lip of the container rim 6 to secure the rotatable lid 3 to the can 1 in a rotatable fashion.

Figure 1:
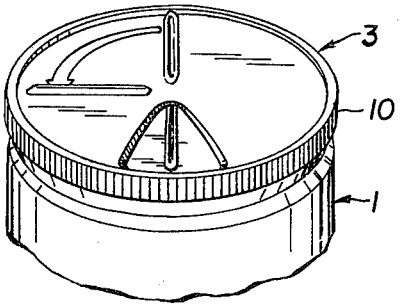
FIG. 1 is a perspective view of the top of a container according to the present invention with parts broken away and shown in section.

The upper portion of the lid flange 8 preferrably has vertical indentations, serrations or ribs 10, as shown in FIG. 1, to facilitate grip during rotation.

The tear back tab 9 is connected to the rotatable lid 3 by means of a short connector tab 11. The tab 11 is riveted at one end 13 to the circular center portion 7 of the lid 3 at a point near the lid perimeter. The opposite end 14 of the connector 11 is riveted to a radially outer corner of the tear back tab 9.

The central disc portion 7 of the lid 3 has a pair of radially extending knurled ribs 17 disposed at 90° and 180° from the opening 15 formed in the lid. The circular top 5 of the container is likewise provided with a pair of radially extending ribs 23 which are approximately 90° and 180° from the tear back tab 9.

The opening 15 formed in the rotatable lid 3 conforms generally to the shape of the tab 9 and has edges 21 which are tapered downwardly toward the circular top portion of the container, as best shown in FIG. 6.

Figure 2:
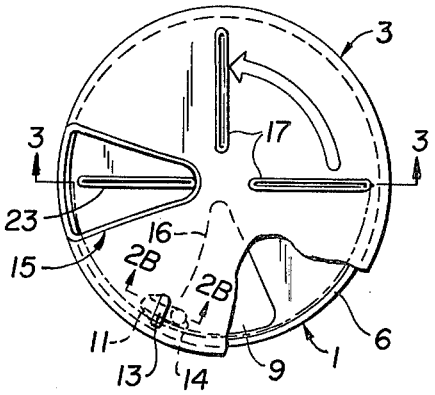
FIG. 2 is a plan view, with parts broken away, showing the rotatable lid in its first (unopened) position.
Figure 3:
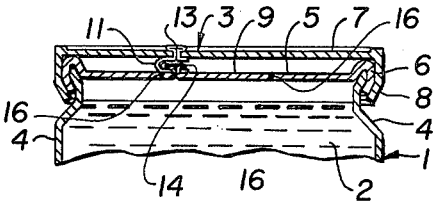
FIG. 3 is a sectional elevational view of the top of the container illustrated in FIG. 2, taken along lines 3—3 thereof.

The operation of the easy opening container described above as illustrated in FIGS. 1 to 6 is as follows: FIGS. 1 to 3 illustrate the container in the closed state wherein the lid 3 is in the so-called first position and the seal of tab 9 in the circular top 5 is, as yet, unbroken. At such position, the aperture 15 of the rotatable lid 3 is located approximately 90° clockwise from the tear back tab 9, as best shown in FIG. 2.

Figure 4:
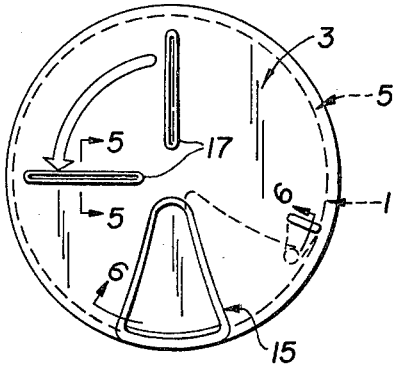
FIG. 4 is a plan view of the container of FIG. 1, wherein the rotational lid has been rotated to its second (open) position.
Figure 5:
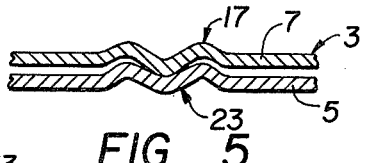
FIG. 5 is a sectional view of the circular lid and rotatable top of the open container of FIG. 4, taken along the lines 5—5 thereof. This view shows surface features on both the top and the lid interlocked when the rotatable top is in the second position.

To open the container 1, the lid 3 is rotated approximately 90° counter-clockwise from its first position, illustrated by FIGS. 1–3, to its second or open position, illustrated by FIGS. 4–6. As the lid 3 rotates counter-clockwise, the connector 11 serves to tear back the tab 9 to form an opening 20 in the circular top 5, as best illustrated in FIG. 6. In this open position, the tab 9 is torn and pulled back and is concealed in the space between the circular top 5 and rotatable lid 3. The lid aperture 15 locates directly above the container opening 20 and the tapered flanges 21 of the lid opening 15 seat against the edges of the container opening 20 to provide a finished appearance, cover the sharp edges of the container opening 20, and prevent the liquid contents 2 from flowing into the space 22 between the container top 5 and the lid 3, and to assist in alignment of the two openings 15, 20.

As best shown in FIG. 5, when the lid is in its second or open position, the lid ribs 17 mate with the ribs 23 formed in the top 5 of the container 1. This provides further assistance in proper registry of the lid aperture 15 with the container opening 20.

FIGS. 7, 7A and 7B illustrate an alternate embodiment of the present invention which is essentially the same as the embodiment of FIGS. 1–6, and like parts bear like reference numerals, except that the connector 11′ has been modified to provide an elongate connection to the pull tab 9′. As best shown in FIG. 7A, the connector 11′ is joined to the lid 3′ and pull tab 9′ by sets of three elongate rivets 13′, 14′ respectively, formed out of the connector 11′ itself. The principal advantage of this embodiment over the previous embodiment is the added strength it provides, thereby mitigating against the connector 11′ breaking loose from the tab 9′.

FIGS. 8, 8A illustrate an alternate embodiment which is essentially the same as the embodiment shown in FIGS. 1–6, with like parts bearing like reference numerals, except that a center pivot connector 30 has been provided between the lid 3″ and can top 5″. Preferably, this pivot connector 30 is formed by riveting the can top 5″ into the lid 3″, so that when the lid 3″ is rotated, it pivots about the connector 30, to provide added strength. This feature can also be used in connection with the embodiments of FIGS. 7, 7A, 7B, and FIGS. 9, 9A and FIG. 11.

FIGS. 9, 9A illustrate a further alternate embodiment of the present invention which is essentially the same as the embodiment of FIGS. 1–6, and like parts bear like reference numerals, except that the connector 11 has been eliminated by riveting the tab 9‴ directly to the rotatable lid 3‴ by means of rivet 31 which is formed out of the metal forming tab 9‴. To minimize binding during operation, the rivet 31 is located in a short extension 32 formed at the radially outer corner of the tear edge of the tab 9‴. A principal advantage of this embodiment is its relative ease of manufacture.

FIG. 11 diagrams the preferred relation of the can top's radius R to the lead tear line L of the tab 9. This preferred relation, which holds true for all embodiments, is as follows: Where opening motion of the lid is $\vec{\theta}$; the $\Delta L$ is any small length of the lead tear edge L; P is the starting point (where the pull tab 9 first breaks loose); and $\theta$ is the angle formed between $\Delta L$ and R; then $\vec{\theta}$ should be greater than 0° for all $\Delta L$'s not including P. The value $\theta$ may be a constant, or variable, although if variable it will generally be preferred to increase in value as it moves away from P.

The trailing tear line T of the tab 9 can be fully formed, so that if the lid 3 is turned far enough, the tab 9 will be fully served from the can top 5; or the tear line T can be only partially formed, as shown in FIGS. 1–6, so that it remains connected to the top 5 after opening has occurred.

It will be noted that those embodiments illustrated in FIGS. 1–10, the tab 9 has a generally triangular shape, with the base of the triangle at the perimeter of the lid 3 and the apex of the triangle located toward the rotational center of the lid 3. This general shape is customary in the industry today since, thereby the user's mouth will not normally wholly cover the dispensing opening, leaving an air hole to prevent a build-up of vacuum retarding flow.

Alternately, it has also been customary to use a smaller dispensing opening (which the user's mouth may fully cover) so long as a separate air hole is provided. FIG. 10 illustrates how such an alternate arrangement can be embodied in the present invention. The embodiment of FIG. 10 is essentially the same as the embodiment of FIGS. 1–6 with like parts bearing like reference numerals, except that two tabs 9⁗ are provided at 180° opposed locations, the smaller of which serves as the air hole, and the larger serving as the dispensing opening.

We claim:

1. A hermetic cylindrical container for carbonated beverages or the like of the type having a circular metal top with a tab scribed therein which may be torn back to provide a dispensing opening, the improvement comprising:

a circular lid enclosing the circular container top, for rotation between first and second positions, said lid having an aperture formed therein; and means connecting said lid to the tab so that when said lid is rotated from said first position to said second position, the tab tears up and away into the space between the circular metal top and said circular lid to provide the dispensing opening, said second position characterized by alignment of the lid aperture with the dispensing opening.

2. The container set forth in claim 1, wherein said connnector means is a member joined at one end to said lid and at the other end to the tab.

3. The container set forth in claim 2, wherein said connector means is joined to the tab at a radial outer location thereon, and to the lid at a location near the lid perimeter.

4. The container set forth in claim 1 wherein, when said lid is in second position, the tab is substantially concealed between said lid and said top.

5. A container set forth in claim 1, wherein the top of said top and the bottom of said lid are each provided with irregularities which interlock to secure said lid in said second position.

6. The container set forth in claim 1, wherein the lid aperture is defined by a downwardly tapered flange.

7. The container of claim 6, wherein said flange seats in the dispensing opening when said lid is in second position.

8. The container of claim 1, wherein said connecting means is a rivet-like portion formed from said tab connecting said lid directly to said tab.

9. The container of claim 8, wherein said connector means is elongate in a direction generally parallel to the radius of lid rotation.

10. The container of claim 1 wherein said lid is rotatably attached to the top by means of a rivet positioned at the rotational center of the lid.

11. The container of claim 8 wherein said tab is generally triangular in shape, with the base of the triangle located at the perimeter of the circular container top, and with the apex of the triangle located toward the center of the circular container top, said tab having a lead tear edge which constitutes that one of the two generally radially extending edges of the generally triangular tab which is severed earliest during operation; and wherein said tab is provided with an extension portion which is offset from said lead tear edge of the tab, and to which said lid is fastened by means of said rivet-like member.

12. The container of claim 1 further comprising a second tab scribed in the circular metal top; and means connecting said second tab to said lid, so that when said lid is rotated to provide the dispensing opening, it tears back said second tab to provide an air hole.

Figure 2A:
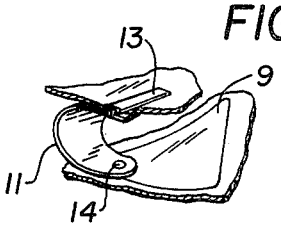
FIG. 2A is a detail perspective view of the tab 9 and connector 11 shown in FIG. 2.
Figure 2B:
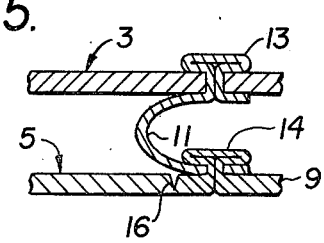
FIG. 2B is a sectional view of the tab and connector of FIG. 2A, taken along line 2B—2B thereof.

13. The container set forth in claim 2 wherein said tab has a tear initiation point which is that portion of the scribed tab at which tear is first initiated; wherein said member is comprised of a flexible metal strip; wherein said strip is joined to said tab with one face flush against the upper surface of said tab; wherein said strip is flexed or bent through approximately 180° and the opposite end of said strip connected to the lower surface of said rotatable lid; and wherein said strip curves away from the surface of said tab from the side of said tab at which said tear initiation point is located, as illustrated by FIG. 2B of the patent drawings.

14. The container set forth in claim 13 wherein said flexible metal strip is joined to said tab by means of a rivet-like portion formed from said tab.

* * * * *